US006586351B1

(12) United States Patent
Breukers

(10) Patent No.: US 6,586,351 B1
(45) Date of Patent: Jul. 1, 2003

(54) STAB-RESISTING MATERIAL, A COATED CARRIER TO BE USED THEREWITH, AND CLOTHING MADE OF SAID MATERIAL

(75) Inventor: Joseph Judtih Breukers, Limbricht (NL)

(73) Assignee: Twaron Products V.O.F., Arnhem (NL)

( * ) Notice: Subject to any disclaimer, the term of this patent is extended or adjusted under 35 U.S.C. 154(b) by 0 days.

(21) Appl. No.: 09/402,370

(22) PCT Filed: Apr. 3, 1998

(86) PCT No.: PCT/NL98/00188

§ 371 (c)(1),
(2), (4) Date: Oct. 21, 1999

(87) PCT Pub. No.: WO98/45662

PCT Pub. Date: Oct. 15, 1998

(30) Foreign Application Priority Data

Apr. 4, 1997 (NL) ..... 1005731

(51) Int. Cl.[7] ..... B32B 11/02; B32B 11/12

(52) U.S. Cl. ..... 442/48; 442/68; 442/69; 442/74; 442/134; 442/135; 428/489; 428/911; 89/36.02

(58) Field of Search ..... 442/48, 68, 69, 442/74, 134, 135; 89/36.02; 428/911, 489

(56) References Cited

U.S. PATENT DOCUMENTS

| | | | | |
|---|---|---|---|---|
| 4,292,882 A | * | 10/1981 | Clausen | 89/36 A |
| 5,414,029 A | * | 5/1995 | Lemoine et al. | 524/60 |
| 5,578,095 A | * | 11/1996 | Bland et al. | 51/295 |

FOREIGN PATENT DOCUMENTS

| | | |
|---|---|---|
| GB | 2 235 929 | 3/1991 |
| JP | 62062198 | 3/1987 |
| WO | WO 97/21334 | 6/1997 |

* cited by examiner

*Primary Examiner*—Terrel Morris
*Assistant Examiner*—John Guarriello
(74) *Attorney, Agent, or Firm*—Oliff & Berridge, PLC

(57) ABSTRACT

A stab-resisting material includes a carrier coated with solid particles, which is provided on a packet of fabrics, in which the coating on the carrier includes abrasive particles having a diameter of 0.1–3 mm, and in which the packet of fabrics is thicker than 1.5 mm. The abrasive particles may be provided on the carrier by an adhesive, which forms an elastic film after curing. In particular, a fabric made of Aramid or Nylon fibres may be used as the carrier material. The preferred adhesive is a bituminous adhesive or an adhesive with a base of polyurethane. This material is used in particular in protective clothing.

18 Claims, No Drawings

STAB-RESISTING MATERIAL, A COATED CARRIER TO BE USED THEREWITH, AND CLOTHING MADE OF SAID MATERIAL

BACKGROUND OF THE INVENTION

1. Field of the Invention

The invention relate to a stab-resisting material consisting of a carrier coated with solid particles, which is provided on a packet of fabrics. The invention furthermore relates to the coated carrier material to be used therewith, and to clothing comprising such stab-resisting material, and to the padding based on the materials according to the invention, which is fitted into such clothing.

2. Summary of the Invention

From International patent application WO 94/09656 a material is known which is capable of withstanding cuts. In particular gloves for use by surgeons are made from said material. The surgeon must be protected against slipping of the knife he is using to carry out an operation, or against injury by fractured bones sticking out and the like. The material to be used for such gloves is built up of several layers, in particular an outside layer, an inside layer, and an intermediate layer. Grains of an abrasive material are provided between said layers. The grains used have a diameter of maximally 0.15 mm. It is important thereby that the surgeon who wears the gloves made of such a material, besides being protected by the glove, also retains the sense of touch in his hands. This is only possible if the material from which the glove is made is thin, and in the aforesaid International patent application an overall thickness of the material of maximally 1.5 mm is indicated. Gloves of this kind are capable of providing the intended effect for a surgeon. The object of the present invention, however, is to provide a material which is capable of withstanding forceful stabbing with a knife, so that the material aimed at by the invention can be used in clothing for police officers, soldiers and the like personnel.

From International Patent Application WO 96/03277 a material is known which provides protection against stabs of a knife and against the impact of bullets and the like, so that such a material can be used in a bulletproof vest which is also capable of withstanding knife stabs. The core of the material is obtained by coating a carrier of Aramid (an aromatic polyamide) with a ceramic by means of plasma sputtering. Thus a ceramic coating having a thickness of maximally 100 micrometers (less than 0.1 millimeters), preferably 20–40 micrometers, is applied to the layer of plastic material. The presence of the ceramic coating on the carrier of plastic material makes the article of clothing comparatively stiff. The object of the invention is to provide article of clothing which is flexible and easy to wear, but which nevertheless provides the required resistance against knife stabs.

From EP-A-0 499 812 an article of clothing is known which is resistant against the impact of bullets as well as to attack with a knife. Grains of glass or ceramic material having a diameter of 4–18 mm are thereby provided on a carrier. Such a material is relatively heavy and not very flexible, but it is effective in preventing penetration by a bullet, although it is less effective against knife stabs.

Research directed at finding a material which is capable of resisting knife stabs and which is easy to wear has resulted in the development of the material as referred to in the introduction, which is characterized in that the coating on the carrier consists of abrasive particles having a diameter of 0.1–3 mm, and that the packet of fabrics is thicker than 1.5 mm.

From U.S. Pat. No. 4,292,882 a material for manufacturing a bulletproof vest is known. The material is built up of several layers of fabric, whereby in particular layer M contains ceramic particles. Said particles are embedded in the fabric by means of a resin or the like, and they are connected together. Any openings between particles are filled with smaller particles. Furthermore, said particles are practically completely enclosed by the bonding resin material, and the various layers are interconnected in many places, so that a laminate is obtained. Said US patent specification does not pay any attention to the operation of the material in preventing penetration with stab weapons. In addition, the material is rigid and not very flexible to wear, so that its wearing comfort is less than satisfactory.

The material according to the invention may be used as a stab-resisting layer, and in particular as lightweight and three-dimensionally flexible and pliable layer or layers, or be used in combination with an underlying packet of fabrics. The material offers the human body a very high degree of protection against stab weapons and sharp and/or pointed objects, such as knives, stilettos, axes, needles and the like. Thus, protective clothing can be obtained for police officers, warders and other officials responsible for order, so that these persons are provided with better protection against stab weapons. Said better protection can be combined-with providing a desired wearing comfort of protective clothing, because the material is flexible and pliable and low in weight. More specifically, these desired properties are obtained by using a material as defined in the subclaims.

According to the principle of the invention the tip and the cutting surface of the knife are damaged when the stab weapon comes into contact with the abrasive particles, after which the underlying protective layers, such as the packet of Aramid fabrics, can stop the damaged knife or slow it down so strongly that the eventual degree of penetration of the protective clothing is acceptable. Said damaging is realised by the presence of abrasive particles, which have been provided on the carrier by means of an adhesive. Another advantage is the fact that the degree of protection does not depend on the angle at which the knife hits the protective layer. The protective layer does not have a preferred orientation, so that the material can be used in all possible directions for manufacturing articles of clothing, and be cut out so as to be tailor-made for the wearer of the protective clothing.

DETAILED DESCRIPTION OF PREFERRED EMBODIMENTS

According to the invention, a material is made which is built up of fine-grained abrasive particles having the diameter of 0.1–3 millimeters, preferably 0.3–0.9 millimeters, which are bonded to a supporting synthetic fabric or carrier by means of a film of adhesive. One or two layers of said coated carrier material are placed on a packet of fabrics. The material thus obtained possesses the stab-resisting properties. The adhesive is applied to the carrier before the abrasive particles are strewn thereon. Then the unbonded excess abrasive particles are removed by turning the carrier upside down or beating it out, and finally the adhesive is cured or dried. The carrier is preferably an Aramid fabric (930 dTex yarn, such as TWARON® CT (an aromatic polyamide) or KEVLAR® 129 (an aromatic polyamide) having a weight of 200 grams/m$^2$). The packet of fabrics is preferably made of the same Aramid fabric as the carrier.

In principle it is possible to use synthetic fabrics for the carrier. Experiments have shown, however, that the best results are obtained by using fabrics made of ballistic Nylon (an aliphatic polyamide) or Aramid fabrics. Normally, Aramid fibers are partially coated with oils or other lubricants to facilitate weaving. Aramid fabrics are often treated with water-repellant substance, because moisture has an adverse affect on the ballistic performance of Aramid. According to the invention, it is preferred to use Aramid fabrics from which these auxiliary substances have been removed prior to weaving, and which have not been subjected to the water-repelling treatment. This leads to an improved bond between the abrasive particles and the carrier fabric, due to a better adherence of the film of adhesive to the Aramid carrier.

From EP-A-0 499 812 it is known that relatively large abrasive particles have a positive effect on the ballistic properties of a composite. Projectiles, such as bullets, are damaged and fragmented by said abrasive particles, as a result of which they can do considerably less damage. From tests it has become apparent, however, that comparatively small abrasive particles, around which the smallest possible amount of a resin or an adhesive is present, provide stab-resisting properties. To this end it is possible to use in particular abrasive particles such as silicon carbide, titanium carbide, alumina, tungsten carbide, titanium nitride, silicon nitride, hard glass and other materials having a hardness of more than 8 on the scale of Moh. Desired properties are obtained in particular by using silicon carbide particles having a particle size of 0.3–0.9 mm. The hardness of the abrasive particles must be greater than that of the stab weapon, and the abrasive particles must ensure that the sharp point of the stab weapon is blunted upon "impact" of the stab weapon, so that the penetrating power, and in particular the cutting power, of the stab weapon will be reduced in a very short space of time, to such an extent that the underlying layers of the protective clothing (the packet of fabrics) can stop the knife and absorb the energy of the impact. The abrasive particles must be prevented from becoming detached from the carrier at the moment of impact of the stab weapon, or from being forced aside during said stabbing. This is realised in particular by means of a suitable adhesive system.

The film of adhesive functions to keep the abrasive particles in position during stabbing, and to prevent them from being moved or forced aside, so that they are capable of carrying out their "blunting" action. In addition to that, the film of adhesive functions to prevent the abrasive particles from becoming detached from the carrier. Accordingly, the composition of said film of adhesive must be such that a proper bond is obtained, both with the abrasive particles and with the fabric-like carrier. Furthermore, the film of adhesive must not be too soft or too yielding. Since generally hardness and stiffness of thermosetting films of adhesive go hand in hand, it must be ensured that the film of adhesive is applied as thinly as possible before strewing the abrasive particles thereon. Research has shown that the adhesive must provide, a flexible, elastic film after curing. In particular, a polyurethane-containing adhesive or a bituminous adhesive may be successfully used for this purpose. In practice an adhesive marketed by the firm of Cindu Chemicals of Uithoorn (NL) under the trade name Cinducoat may be used for this purpose. This adhesive is a bituminous emulsion. In order to further prevent displacement of the particles, it may be advantageous to apply a second film of adhesive to the particle-coated carrier. The carrier thus coated is placed on the packet of fabrics in one or two layers. In principle the coated carrier lies loosely on the packet of fabrics. In order to facilitate fitting it into clothing and to prevent it from shifting inside said clothing, the coated carrier may be fixed to the packet of fabrics near the corner points or along the edges. In principle the packet of fabrics itself consists of layers of Aramid fabric or the like, which are placed loosely one on top of the other. In order to prevent said layers from shifting, it is also possible to interconnect the layers of which the packet of fabrics is built up in a few places. It is to be preferred, however, to connect the layers of which the packet of fabrics are built up in as few places as possible, in order to keep the structure as loose as possible. In order to make it possible to fit the whole of packet of fabrics and carrier provided thereon in clothes without difficulty, it is to be preferred to envelop the whole in a cover made of a lining material, in particular a polyester lining material.

The invention will be explained in more detail by means of the following examples.

EXAMPLE 1

A bituminous adhesive is applied to a carrier fabric having a weight of 200 g/m$^2$, which is built up of 930 dTex TWARON® CT yarn, by means of a brush. The adhesive is CINDUCOAT® adhesive (marketed by Cindu Chemicals of Uithoom (NL)). The adhesive is applied in an amount of 130 g/m$^2$ of fabric. The abrasive particles are strewn into the wet film of adhesive. For this purpose 750 g/m$^2$ of silicon dioxide carbide having a particle size of about 0.4 mm are used. A particle size such as the above is known in practice by the designation F40. The particles are marketed by the firm of Orkla Exolon of Orkanger (Norway). The amount of 750 g/m$^2$ is the amount which remains behind on the film of adhesive after the unbonded excess particles has been removed. Once the excess silicon carbide particles has been removed, the adhesive is dried at room temperature. After about 4.5 hours the adhesive is sufficiently dry.

Thus, a coated carrier has been obtained. It is possible to apply a second film of adhesive to the coated carrier, so that the a particles are properly fixed on both sides. To this end a film of adhesive is applied as thinly as possible, in an amount which is approximately half the amount of adhesive that has been applied in the first processing step.

EXAMPLE 2

The coated carrier obtained in example 1 is placed on a packet of fabrics consisting of 24 layers of Aramid fabric. The coated carrier will at all times be positioned on the packet of fabrics in such a manner that a knife will first strike the abrasive particles before coming into contact with the carrier. The various layers of Aramid fabric in the packet of fabrics correspond with the carrier material used in example 1. The packet of fabrics with the coated carrier present thereon is enveloped in a polyester lining material, so as to be able to handle the whole more easily. The material according to the invention, which consists of a packet of fabrics and a coated carrier provided thereon, can thus be readily slipped into an article of clothing as padding.

EXAMPLE 3

Example 1 is repeated, whereby a polyurethane-containing adhesive is used instead of a bituminous adhesive. Sikaflex 221 is used as the polyurethane-containing adhesive. This adhesive is marketed by Sika B.V. of Maarssen. When this polyurethane adhesive is used, it will not be necessary to apply a second film of adhesive to the coated carrier.

EXAMPLE 4

Example 2 is repeated, whereby the material of the invention is built up of a packet of fabrics with two carriers coated with abrasive particles according to example 1 present thereon, whereby said coated carriers are placed one on top of the other, so that the carrier material of the second coated carrier will lie on top of the first layer of abrasive particles.

TEST

The material obtained according to example 2 was subjected to a test. To this end the material according to the invention was placed on a block of clay. A down pipe was placed above the material according to the invention, and a knife, weighted with a weight of 2.6 kg, was dropped through the down pipe from a height of 1.8 m. This results in an impact energy of 46 Joules. The knife is marketed as article L-113 by the firm of H.M. Slater Ltd., Sheffield (UK). This knife is also specified in the UK stab-resistance test in accordance with PSDB. Upon examination after the fall it appeared that the knife had not penetrated the packet of fabrics, and that it had only caused an indent in the clay. A well-defined imprint of the knife in the clay could not be observed, therefore.

What is claimed is:

1. A stab-resisting material, comprising a carrier consisting of a fabric, wherein the fabric is coated with an adhesive and then coated with abrasive particles, which coated carrier is provided on a packet of fabrics, wherein the coating of abrasive particles on said carrier comprises abrasive particles having a diameter of 0.1–3 mm, and that the packet of fabrics is thicker than 1.5 mm, and wherein said adhesive is a bituminous adhesive.

2. The material according to claim 1, wherein said abrasive particles have a diameter of 0.3–0.9 mm.

3. The material according to claim 1, wherein said abrasive particles have a hardness of at least 8 on the scale of Moh.

4. The material according to claim 1, wherein the material for the abrasive particles is selected from the group consisting of silicon carbide, titanium carbide, alumina, tungsten carbide, titanium nitride, and silicon nitride.

5. The material according to claim 1, wherein said abrasive particles have been provided on the carrier by a film of adhesive.

6. The material according to claim 5, wherein said adhesive forms a flexible, elastic film after curing.

7. The material according to claim 5, wherein a second film of adhesive is applied to the coated carrier.

8. The material according to claim 5, wherein said carrier consists of Aramid fabric which has been woven from fibers from which auxiliary substances have been removed in order to provide a better bond between said abrasive particles and said adhesive.

9. The material according to claim 8, wherein the auxiliary substances comprise lubricants and water-repellent substances.

10. The material according to claim 1, wherein said carrier is made of an Aramid fabric or of a Nylon fabric.

11. The material according to claim 1, wherein the coated carrier lies practically loosely on a packet of fabrics, which packet of fabrics consists of more than 10 layers of an Aramid fabric or of a Nylon fabric.

12. The material according to claim 11, wherein the coated carrier lies loosely on the packet of fabrics in those places where protection against knife stabs is required.

13. The material according to claim 1, wherein several coated carriers lie one on top of the other, and that the whole of coated carriers is present on the packet of fabrics.

14. The material according to claim 1, wherein the layers of which the packet of fabrics is built up lie substantially loosely on top of each other.

15. A coated carrier material to be used for manufacturing the material according to claim 1, comprising a carrier comprising abrasive particles provided thereon by an adhesive.

16. Padding for protection against stabbing, wherein the material according to claim 1 is enclosed in a polyester lining material.

17. Protective clothing, which offers protection against stab weapons, wherein said clothing is provided with a material as defined in claim 1.

18. The material according to claim 1, wherein the stab-resisting material exhibits a property of preventing penetration of a knife weighted with a weight of 2.6 kg dropped from a height of 1.8 m.

* * * * *

UNITED STATES PATENT AND TRADEMARK OFFICE

CERTIFICATE OF CORRECTION

PATENT NO. : 6,586,351 B1
DATED : July 1, 2003
INVENTOR(S) : Joseph Judith Breukers It is certified that error appears in the above-identified patent and that said Letters Patent is hereby corrected as shown below:

Title page,
Item [73], Assignee, please change "Twaron Products V.O.F., Arnhem (NL)" to read -- Teijin Twaron GmbH, Wuppertal (DE) --.

Signed and Sealed this

Twenty-fifth Day of October, 2005

JON W. DUDAS
*Director of the United States Patent and Trademark Office*